US012168911B2

(12) United States Patent
Williams

(10) Patent No.: US 12,168,911 B2
(45) Date of Patent: Dec. 17, 2024

(54) VALVE APPARATUS

(71) Applicant: Danny T. Williams, Katy, TX (US)

(72) Inventor: Danny T. Williams, Katy, TX (US)

( * ) Notice: Subject to any disclaimer, the term of this patent is extended or adjusted under 35 U.S.C. 154(b) by 122 days.

(21) Appl. No.: 17/576,810

(22) Filed: Jan. 14, 2022

(65) Prior Publication Data

US 2023/0142178 A1 May 11, 2023

Related U.S. Application Data

(60) Provisional application No. 63/276,584, filed on Nov. 6, 2021.

(51) Int. Cl.
*E21B 34/10* (2006.01)
*E21B 17/10* (2006.01)

(52) U.S. Cl.
CPC ..... *E21B 34/10* (2013.01); *E21B 17/1014* (2013.01)

(58) Field of Classification Search
CPC ..... E21B 34/10; E21B 17/1014
USPC ..... 166/321
See application file for complete search history.

(56) References Cited

U.S. PATENT DOCUMENTS 3,868,995 A * 3/1975 Crowe ..... E21B 34/101 166/324
5,265,844 A * 11/1993 Westfall ..... F16L 37/40 62/50.7
5,603,386 A * 2/1997 Webster ..... E21B 44/005 175/45
2020/0080397 A1* 3/2020 Walker ..... F16K 5/0652

* cited by examiner

*Primary Examiner* — Tara Schimpf
*Assistant Examiner* — Patrick F Lambe
(74) *Attorney, Agent, or Firm* — Kearney, McWilliams & Davis, PLLC; John M. DeBoer

(57) ABSTRACT

A valve apparatus having a valve body configured with a flow passage. There is a main piston movably disposed within the flow passage, and configured to move to and from a first piston position to a second piston position. The valve apparatus also has a movable member movably disposed within the valve body, the movable member comprising: a no-go position for stopping movement of the main piston, and a go position to facilitate movement of the main piston.

20 Claims, 9 Drawing Sheets

345
340a 343
362

340b
360

VALVE APPARATUS

BACKGROUND

Field of the Disclosure

Historically rotary drilling was the only method used to drill wells. As shown in FIG. 1A (shown in simplified form), a basic rotary assembly 100 is comprised of a drill bit 101 connected by threads to the end of a bottom hole assembly (BHA) 102. Right above the bit, there are a few nonmagnetic drill collars (NMDC) and several steel drill collars and or heavy-weight drill collars 103, which are intended to house any navigation instrumentation and apply load to the drill bit. This assembly 101/102//103 is connected to the surface S via drill string 104, which is the only means to transfer the rotary force from the surface S to the drill bit 101. Typical surface equipment includes a rig or derrick 106 and a rotation mechanism 107, such as a top drive, rotary table, or the like.

The main limitations of the rotary assembly are that it is only able to drill straight and vertical sections of the well bore 105 and its trajectory, and is not steerable. So when the drill bit 101 deviates from its intended trajectory, the assembly has to be pulled out of the hole (POOH) and replaced with a different configuration to correct the well path trajectory. The disclosure of the mud motor addressed these limitations, and overnight, revolutionized the drilling industry.

As seen in FIG. 1B (shown in simplified form), all mud motors 100*a* available in the industry today have three main components, i.e., power section 108, bent section 109, and bearing section 110. FIG. 2 shows the various sections of the basic mud motor 100*a*. Starting from top of the motor 100*a*, the first item of discussion is the top sub 112. The top sub 112 is normally used as a cross over between the mud motor and the non-magnetic drill collars. The said top sub is threaded and attached to the power section 108.

The power section 108 converts the hydraulic horsepower, of the drilling fluid, into mechanical horsepower for the mud motor 100*a*. The generated horsepower is transferred to the drill bit 101 via a transmission shaft and a set of bearings, housed in the bearing section 110 of the mud motor 100*a*. So, unlike rotary drilling, the power from the mud motor 100*a* to the drill bit is supplied through hydraulic horsepower into mechanical horsepower through the downhole mud motor 100*a* and is not generated by rotary drilling, through rotation of the drill string at the surface, and transferred by the drill string to the drill bit. As the name indicates, the bent housing 109 has a small bend (normally from 0.0° to 3.0°) machined into the body of the said bent housing 109.

As mentioned before, the use of a mud motor 100*a* makes the entire assembly 102 steerable, which eliminates the need to trip out of the hole and change the assembly to make the necessary well trajectory correction. When drilling with a mud motor assembly 100*a*, there are two basic modes of drilling, i.e., rotary mode and sliding mode. FIG. 1C (shown in simplified form) shows a side view of a mud motor 100*a* in a rotary steerable mode. That is, when drilling a straight path with the mud motor 100*a*, the entire drill string 104 and BHA 102 are rotating. This surface rotating action, of the drill string 104, serves several useful purposes. It keeps the drill bit 101 on a somewhat straight path by eliminating the affect of the bend in the mud motor assembly 100*a*.

When drilling straight ahead is desired, the rotary mode is used. In this mode, the entire drill string 104 and the BHA

102 (with mud motor 100*a*), is continuously rotating to cancel out the affect of the bend and keep the BHA on a relatively straight trajectory. But for various reasons, the drill bit 101 tends to gradually deviate from the intended path.

This action also converts the static coefficient of friction to a dynamic one. Since the dynamic coefficient of friction between the BHA and the formation is less than the static one, the surface rotating action of the drill string 104 to the BHA 102 reduces the drag between the BHA 102 and the walls of the wellbore 105. This allows more of the applied weight to reach the drill bit 101 and result in a faster penetration rate, cleaner wellbore and longer horizontal distances.

In the event the drill bit 100 deviates from its intended path, the correction is done by slide drilling. FIG. 1D shows an example of slide drilling. To slide the assembly 102, the rotation of the BHA 102, from rotation of the drill string 104 at the surface, is halted, the bend on the motor 100*a* is pointed to the intended direction, and the entire assembly 102/104 is pushed down from the surface to direct the drill bit 101 towards the intended direction. The bend in the motor 100*a* is aligned at the surface to a down hole guidance tool, directly above the mud motor, prior to the drilling operation.

This guidance tool gives a downhole indication of which way the bend in the motor is pointing in relationship to the upper side and lower part of the well bore as it pertains to the wellbores actual azimuth direction. This is called gravity tool face. It requires angle in the well bore in excess of 1.5°-3° of inclination. The guidance tool can also give an azimuth direction tool face, in relationship to the well bores current azimuth position, to determine an azimuth direction of which way the bend of the motor is pointing, called magnetic tool face.

Slide drilling is the method of controlling the trajectory of the wellbore 105 to a desired, path by controlling the azimuth direction and inclination of the wellbore 105. Rotatory drilling, after slide drilling, somewhat holds the changed path with marginal results. More often than not, in the rotation mode, the wellbore 105 follows the trajectory of the changed direction previously slid. It is usually at less, or more, a rate of change than the results achieved during the slide drilled portion of wellbore, depending on which direction the bit was slid.

This can cause the trajectory to over shoot the intended results from the slide drilled portion. Also, the formation can somewhat dictate undesirable influences on the well path in the rotation mode. If one had the ability downhole to lift the back portion of the BHA and or the back portion of the drill bit at a designated point above or below the drill bits current position and to a designated height in the well bore, while in the rotating mode, it would help control the results of the well bore trajectory. On the other hand, while in the slide drilling mode, one would also want to take away that designated lift point so it would not interfere with the slide results or cause excess drag during slide drilling.

The user controlling the designated lifting point, from the surface to activate it down hole, is the basis of this disclosure.

The same principal, of the user controlling a designated lifting point from the surface with a mud motor, can also be applied to a rotary drilling assembly that, has no mud motor but, needs the lifting of a designated point within the BHA to adjust the current position of the drill bit while rotary drilling.

The same principal of the user controlling from the surface, a means to turn on or off a valve down hole, or turn on or off fluid flow down hole, or attach and release an object down hole, or open or close a sleeve or port downhole, all can be activated and deployed with this disclosure.

What is needed is the ability to provide or facilitate making down hole adjustments from the surface to, re-configure the BHA without having to POOH, allow fluid flow (or not) through the drill string or outside it, activate a latching or unlatching mechanism, re-direct fluid flow in or around downhole components, and activate or deactivate sliding sleeves downhole.

The needs above encompass, but are not limited to, things such as the ability to control the drill bit trajectory (such as in a conventional rotary or steerable mud motor assembly), ability to open a port in the drill string and bypass fluid flow from inside the drill string to outside (for possible cementing or fracking), ability to activate a sliding sleeve open to closed (such as in fracking), ability to operate latching and releasing mechanisms to catch or drop off tubulars (such as liners, packers, whipstocks or fishing operations), ability to redirect the path of the drill string flow (such as diverting flow from and to an agitator down hole vibrator), ability to activate or deactivate a cutting or reaming tool (such as a reamer in the oil industry or medical industry), ability to activate or deactivate a bladder or balloon, (such as a packer or stint) and ability to orient and activate or deactivate all of the above (such as an alternating pad, port, hole or cutting tool).

SUMMARY

Embodiments of the disclosure pertain to a valve apparatus for use in controlling fluid flow, which may be applicable in a number of industries, such as oil and gas, medical, and the like. Embodiments herein pertain to a downhole stabilizer tool.

Embodiments of the disclosure may be used to improve wellbore control, down hole, while drilling with steerable mud motors and conventional bottom hole assemblies (BHA). Its ability, at the surface, to move and adjust, down hole, above or ahead of the drill bit, a designated position in the BHA or drill string, up or down and left or right, can create down hole control in changing the path of the well bores trajectory. This applies when rotating the drill string or sliding the drill string with this apparatus.

The ability, from the surface, to adjust a designated position in the BHA or drill string, down hole above or ahead of the drill bit, will control the well bore trajectory while rotating the drill string and also allows the excavation of the long-reach horizontal and directional wellbores, cleaner well bores, greater rates of penetration (ROP), smoother profiles for production casing, less drill solid sump traps in wellbore profiles and better well bore trajectory control after slide corrections.

These objectives are met by the employment of one or more retractable stabilizer subs in the BHA and/or drill string. The retractable stabilizer sub can also be integrated as a part of the BHA, and/or drill string and also a part of the actual mud motor. The functionality of the apparatus also has applications in controlling the activation of down hole reamers, casing sleeves, frac sleeves, on off valves, on off latches and many other down holehole drilling and hole production applications. Embodiments herein are not limited to just the subsurface drilling industry but also has applications in medical, industrial industries and many other industries that can use similar functionality to achieve different results.

The above-described object of the disclosure advantages, as well as other objects and advantages, are achieved by the surface orientation of the retractable stabilizer sub and the drill mud surface pressure. At a certain surface orientation of the retractable stabilizer sub, ports are internally opened, allowing drill mud and pressure to energize pistons, which engage multiple or individual blades that move out to contact the well bore. This contact lifts or pushes the blades, which controls a designated contact point above or below the drill bit in the BHA, to produce better and more predictable control while in rotary or slide drilling mode. The scribe line(s) on the retractable stabilizer sub or multiple subs are aligned relative to the scribe line of the mud motor which is aligned to the guidance tool, as mentioned earlier.

Embodiments of the disclosure may activate with drill mud pressure after a pre-determined surface orientation of the internal workings of the disclosure relative to the scribe alignment of the mud motor. Also, the described internal mechanical workings that open ports, to the drill mud and pressure, of the retractable stabilizer sub, can also be used to perform many other functions. A few other functions, but not limited to, are controlling valves, frac sleeves, reamers, whip-stocks, milling tools, releasing tools and many others. The operating mechanism can be placed in drill strings, BHA, mud motors, logging tools, production tools, fishing tools, casing tools, etc., above or below the surface.

Embodiments herein may provide for valve apparatus having a rotatable or movable member or block configured with a go/no-go configuration. The no-go configuration may include a passage for the piston, and an open go passage for the piston. This configuration may provide multifunction capability in that orienting a valve housing(s) in one or more positions may be achieved. For example, orienting to either the upper or lower section of the wellbore.

In other aspects, it may be possible to have multiple passages in the rotatable member that do other functions. For example, there may be four possible functions on the rotatable member that the piston could attain the housing(s) were oriented to the upper, lower, left or right side of the wellbore. This may facilitate or allow fluid to flow to an outer port or while the upper and lower functions the blades.

Embodiments herein may provide for a piston configured with multiple ports, including a port that lines up inside the housing to achieve flow (such as to the surrounding wellbore) when the orientation was left or right and the rotatable block allowed the piston to only move to that position of alignment.

Embodiments herein readily illustrate the valve apparatus may do more than just two functions, especially with modification to the rotatable member.

Other embodiments herein pertain to a valve apparatus that may include one or more of: a valve body comprising a flow passage; a main piston movably disposed within the flow passage (the main piston may be configured to move to and from a first piston position to a second piston position and/or the main piston may have an extended piston end and an inner piston passageway; a chamber formed in the valve body (the chamber may have an actuatable device, such as an at least one movable piston); a blade coupled with the actuatable device; a movable member movingly disposed within the valve body.

The moveable member may have a shoulder for stopping movement of the main piston by abutting the extended piston end, and an opening for the extended piston end to pass therethrough.

In aspects, rotation of the valve apparatus may result in rotation of the movable member in a sufficient manner to allow the main piston to move from the first position to the second position. The second position may correspond with fluid pressure entering the chamber to the movable piston and extending the blade.

The valve body may include a first housing coupled with a second housing. The chamber may be disposed within the first housing. The movable member may be disposed within the second housing. The main piston may have a piston port. The valve body may include a body port proximate the chamber. The main piston may be in its first position, and as such the piston port and the body port may be unaligned—this may prevent flow to the chamber. The main piston at other times may be in another or second position, whereby the piston port and the body port may align in order to establish fluid flow between the chamber and inner piston passageway.

The movable member comprises a member body weighted portion and an open portion. In aspects, the member body weighted portion may be configured to prevent the main piston to move to the second position.

Upon rotation or other suitable movement of the valve apparatus and/or application of fluid pressure, the extended piston end may be able to move in a manner whereby the main piston moves to the second position.

The movable member and/or the valve body may have respective tracks. A set of rollers may be disposed in or otherwise engage the respective tracks. At least a portion of fluid pressure in the chamber may be relieved out of a pressure relief cap disposed in the valve body.

Yet other embodiments of the disclosure pertain to a valve apparatus that may include a valve body configured with a flow passage. There may be a main piston movably disposed within the flow passage. The main piston may be configured to move to and from a first piston position to a second piston position. The main piston may have an extended piston end and an inner piston passageway.

There may be a chamber formed in the valve body. There may be an at least one actuatable device disposed in or proximate the chamber. There may be a movable member movably disposed within the valve body. The movable member may include a no-go position for stopping or hindering movement of the main piston. The movable member may include a go position to facilitate movement of the main piston (and its extended piston end).

In operation, movement of the valve apparatus may result in movement of the movable member in a sufficient manner to allow the main piston to move from the first position to the second position. This may include the second position corresponding with fluid pressure entering the chamber to the actuatable device.

These and other embodiments, features and advantages will be apparent in the following detailed description and drawings.

BRIEF DESCRIPTION OF THE DRAWINGS

A full understanding of embodiments disclosed herein is obtained from the detailed description of the disclosure presented herein below, and the accompanying drawings, which are given by way of illustration only and are not intended to be limitative of the present embodiments, and wherein.

DETAILED DESCRIPTION

Figure 1A:
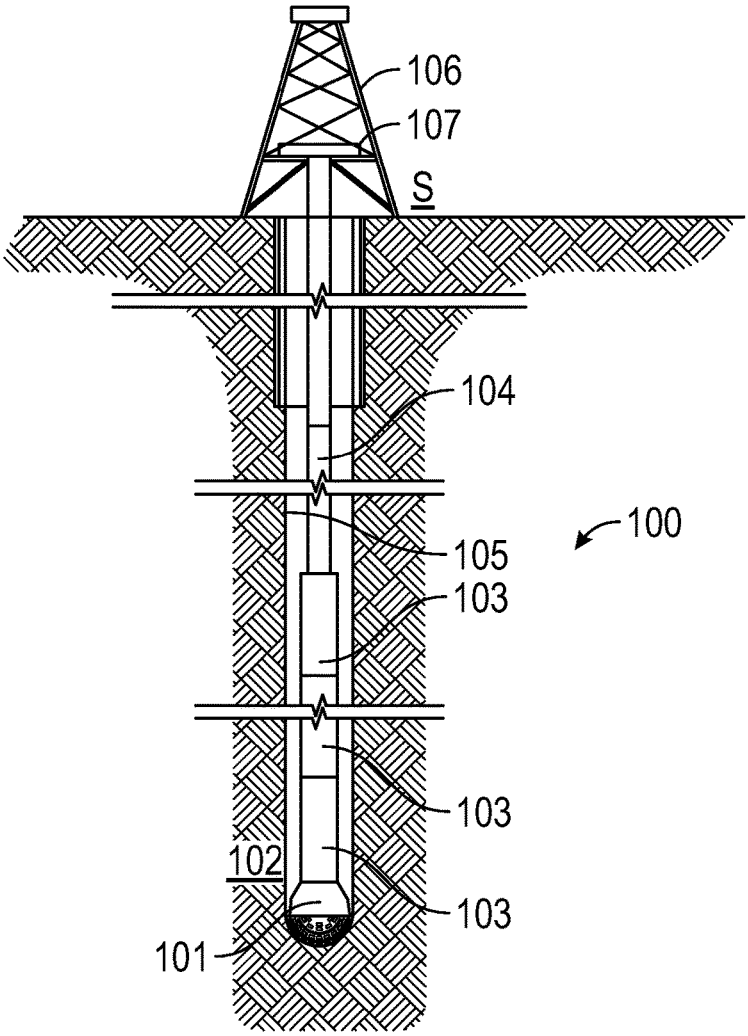
FIG. 1A (PRIOR ART)
FIG. 1A shows a schematic illustration of a conventional rotary drilling used to drill vertical wells.
Figure 1B:
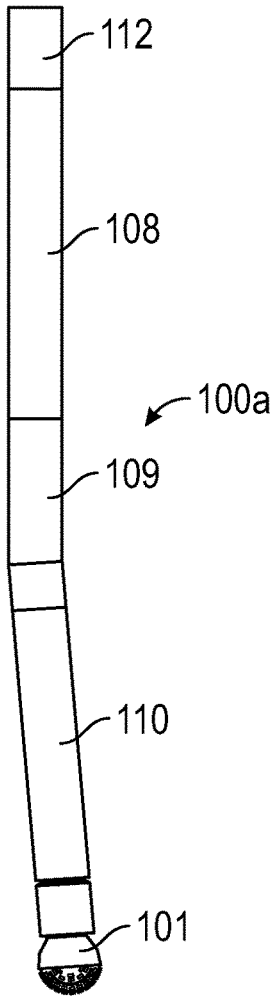
FIG. 1B (PRIOR ART)
FIG. 1B shows the basic main components of a typical mud motor.
Figure 1C:
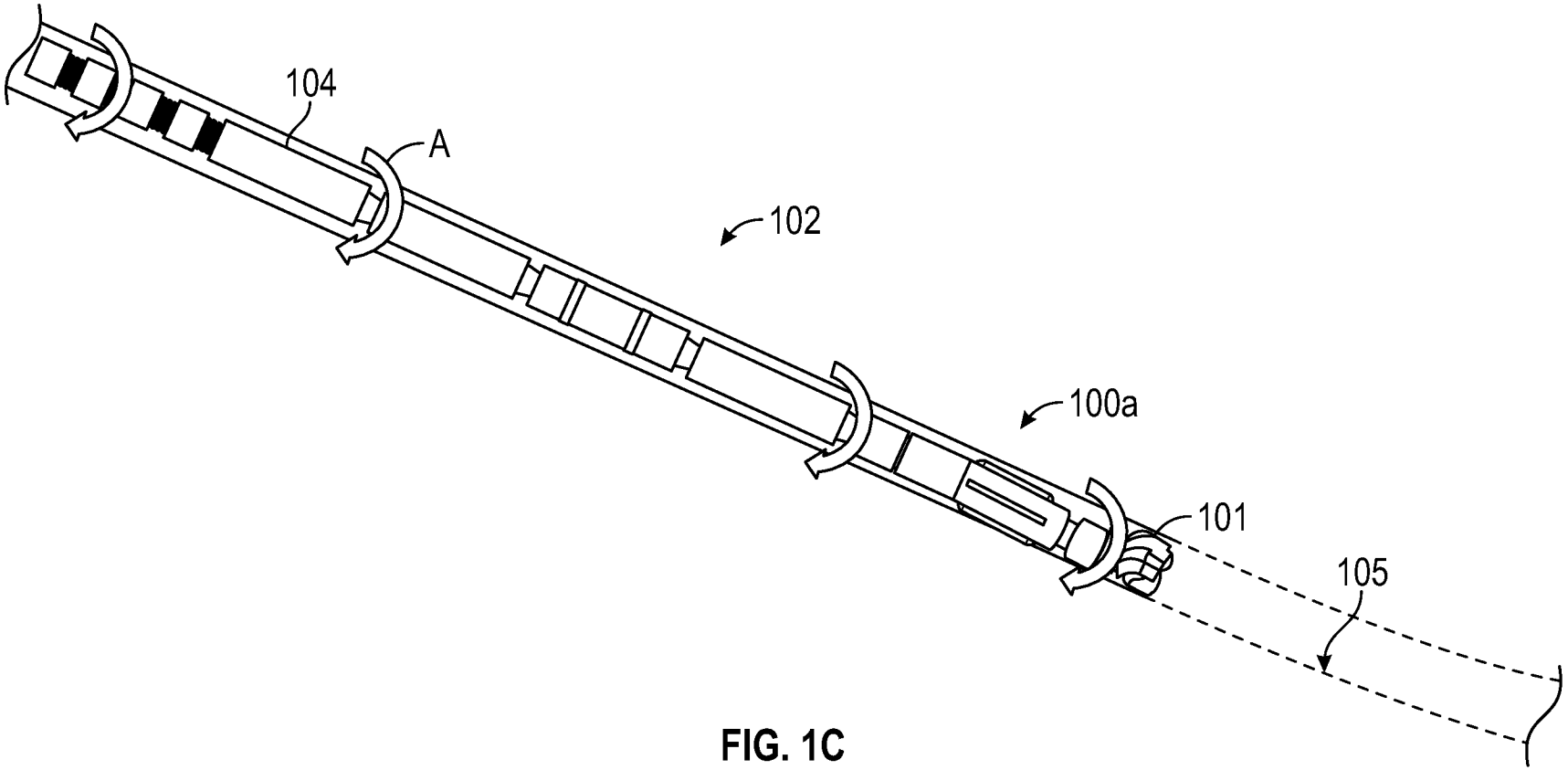
FIG. 1C (PRIOR ART)
FIG. 1C shows a steerable mud motor assembly in the rotary drilling mode.
Figure 1D:
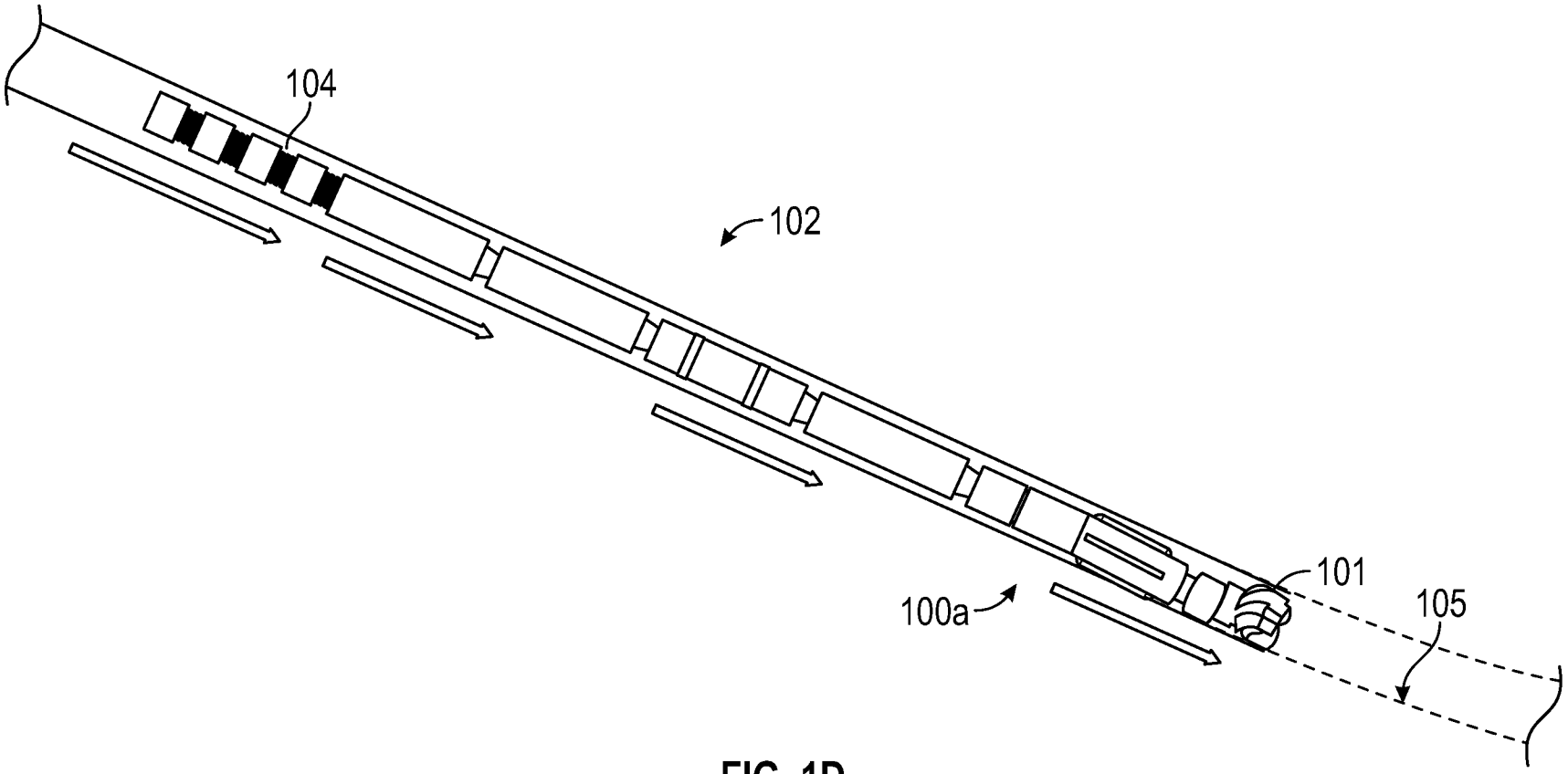
FIG. 1D (PRIOR ART)
FIG. 1D shows a steerable mud motor assembly in the slide drilling mode.

Regardless of whether presently claimed herein or in another application related to or from this application, herein disclosed are novel apparatuses, units, systems, and methods that pertain to improved downhole operations, details of which are described herein.

Embodiments of the present disclosure are described in detail with reference to the accompanying Figures. In the following discussion and in the claims, the terms "including" and "comprising" are used in an open-ended fashion, such as to mean, for example, "including, but not limited to . . . ". While the disclosure may be described with reference to relevant apparatuses, systems, and methods, it should be understood that the disclosure is not limited to the specific embodiments shown or described. Rather, one skilled in the art will appreciate that a variety of configurations may be implemented in accordance with embodiments herein.

Although not necessary, like elements in the various figures may be denoted by like reference numerals for consistency and ease of understanding. Numerous specific details are set forth in order to provide a more thorough understanding of the disclosure; however, it will be apparent to one of ordinary skill in the art that the embodiments disclosed herein may be practiced without these specific details. In other instances, well-known features have not been described in detail to avoid unnecessarily complicating the description. Directional terms, such as "above," "below," "upper," "lower," "front," "back," etc., are used for convenience and to refer to general direction and/or orientation, and are only intended for illustrative purposes only, and not to limit the disclosure.

Connection(s), couplings, or other forms of contact between parts, components, and so forth may include conventional items, such as lubricant, additional sealing materials, such as a gasket between flanges, PTFE between threads, and the like. The make and manufacture of any particular component, subcomponent, etc., may be as would be apparent to one of skill in the art, such as molding, forming, press extrusion, machining, or additive manufacturing. Embodiments of the disclosure provide for one or more components to be new, used, and/or retrofitted to existing machines and systems.

Various equipment may be in fluid communication directly or indirectly with other equipment. Fluid communication may occur via one or more transfer lines and respective connectors, couplings, valving, piping, and so forth. Fluid movers, such as pumps, may be utilized as would be apparent to one of skill in the art.

Numerical ranges in this disclosure may be approximate, and thus may include values outside of the range unless otherwise indicated. Numerical ranges include all values from and including the expressed lower and the upper values, in increments of smaller units. As an example, if a compositional, physical or other property, such as, for example, molecular weight, viscosity, melt index, etc., is from 100 to 1,000. it is intended that all individual values, such as 100, 101, 102, etc., and sub ranges, such as 100 to 144, 155 to 170, 197 to 200, etc., are expressly enumerated. It is intended that decimals or fractions thereof be included. For ranges containing values which are less than one or containing fractional numbers greater than one (e.g., 1.1, 1.5, etc.), smaller units may be considered to be 0.0001, 0.001, 0.01, 0.1, etc. as appropriate. These are only examples of what is specifically intended, and all possible combinations of numerical values between the lowest value and the highest value enumerated, are to be considered to be expressly stated in this disclosure. Numerical ranges are provided within this disclosure for, among other things, the relative amount of reactants, surfactants, catalysts, etc. by itself or in a mixture or mass, and various temperature and other process parameters.

TERMS

The term "connected" as used herein may refer to a connection between a respective component (or subcomponent) and another component (or another subcomponent), which may be fixed, movable, direct, indirect, and analogous to engaged, coupled, disposed, etc., and may be by screw, nut/bolt, weld, and so forth. Any use of any form of the terms "connect", "engage", "couple", "attach", "mount", etc. or any other term describing an interaction between elements is not meant to limit the interaction to direct interaction between the elements and may also include indirect interaction between the elements described.

The term "pipe", "conduit", "line", "tubular", or the like as used herein may refer to any fluid transmission means, and may (but need not) be tubular in nature.

The term "engine" as used herein may refer to a machine with moving parts that converts power into motion, such as rotary motion. The engine may be powered by a source, such as internal combustion.

The term "motor" as used herein may be analogous to engine. The motor may be powered by a source, such as electricity, pneumatic, or hydraulic.

The term "utility fluid" as used herein may refer to a fluid used in connection with the operation of a heat generating device, such as a lubricant or water. The utility fluid may be for heating, cooling, lubricating, or other type of utility. 'Utility fluid' may also be referred to and interchangeable with 'service fluid' or comparable.

The term "mounted" as used herein may refer to a connection between a respective component (or subcomponent) and another component (or another subcomponent), which may be fixed, movable, direct, indirect, and analogous to engaged, coupled, disposed, etc., and may be by screw, nut/bolt, weld, and so forth.

The term "pipe", "conduit", "line", "tubular", or the like as used herein may refer to any fluid transmission means, and may (but need not) be tubular in nature.

The term "pump" as used herein may refer to a mechanical device suitable to use an action such as suction or pressure to raise or move liquids, compress gases, and so forth. 'Pump' can further refer to or include all necessary subcomponents operable together, such as impeller (or vanes, etc.), housing, drive shaft, bearings, etc. Although not always the case, 'pump' may further include reference to a driver, such as an engine and drive shaft. Types of pumps include gas powered, hydraulic, pneumatic, and electrical.

Figure 2A:
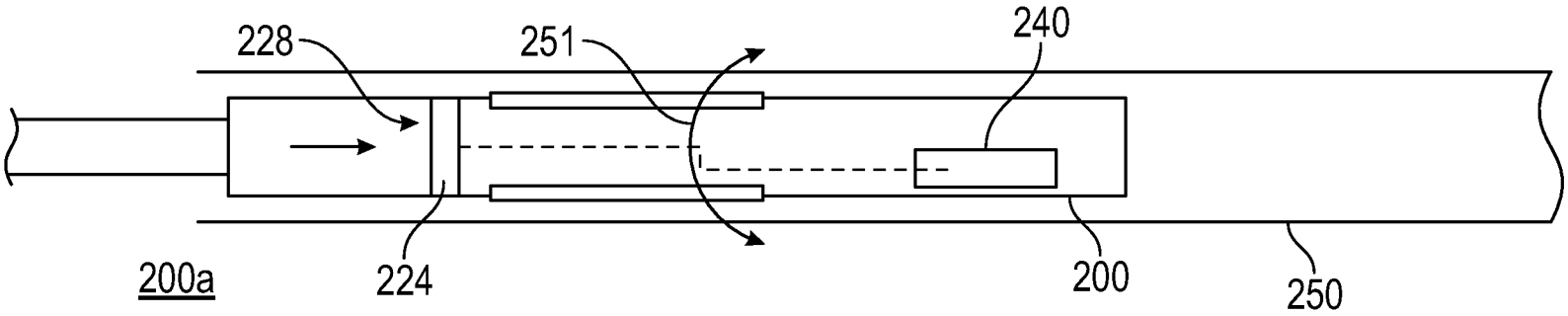
FIG. 2A shows a simplified block diagram view of a valve apparatus in a first position according to embodiments of the disclosure.
Figure 2B:
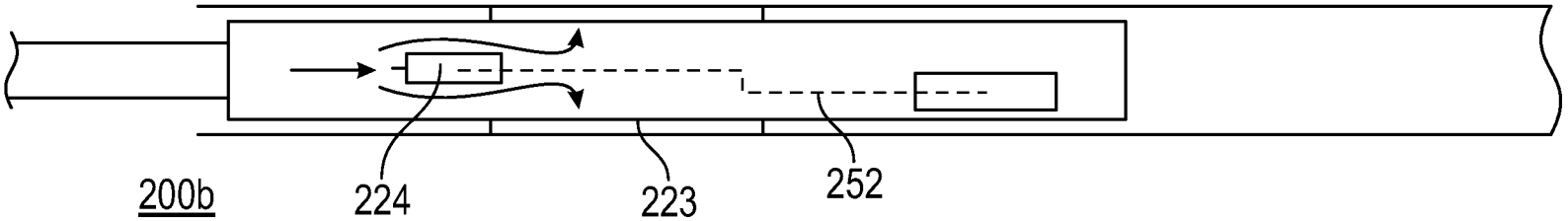
FIG. 2B shows a simplified block diagram view of the valve apparatus of FIG. 2A in a second position according to embodiments of the disclosure.

Referring now to FIGS. 2A and 2B together, a simplified block diagram view of a valve apparatus in a first position, and a simplified block diagram view of the valve apparatus, respectively, illustrative of embodiments disclosed herein, are shown.

FIGS. 2A and 2B generally illustrate an embodiment of a valve apparatus (or "valve assembly", "valve", etc.) 200, which may have a wide variety of applications. Generally the valve 200 is not limited to any particular size, dimension, scale, material of construction, and other properties, such that its use is vast.

For example, the valve 200 may be installed within a tubular 250 (or other type of surrounding structure, which might be anything from part of a body (such as a vein) or a wellbore. The valve 200 may have a valve body configured as a first housing 221, which may be a unitary or integral structure, and thus a primary or main housing. The housing 221 may be contemplated as a blade housing, in that one or more movable blades 223 may be disposed or coupled therewith. In that the applications of use are wide, one of skill would appreciate the configuration of the extending blade 223 may be conformable for any such use. The same being the case for any component of the valve 200.

Although not shown here, the valve 300 may have one or more ends configured for, coupling with other devices, such as a utility or work strong 254 (e.g., drill string, a medical scope, etc.

The first housing 221 may be tubular or hollow in nature, and thus may have an inner housing passage or chamber 235. The first housing 221 may contain or house a main piston (or other suitable member) 224. Although not shown here, there may be an energizer (such as a spring) disposed around or engaged with the piston 224 that relates to movement thereof (such as from a first position 200*a* to a second position 200*b*).

The first housing 221 may have one or more (sealed) port(s), which may be configured as main supply ports for (pressurized) fluid 228 to a set of piston chambers (not shown here) associated with the blade(s) 223. The first housing 321 may also have a scribe or reference 230. The reference 230 may be used to illustrate the movement of the housing 221 upon rotation (see reference arrow 251). For example, the housing 221 may be in a first position 200*a* (FIG. 2A), and then as the valve 200 is rotated, the housing 221 may be in a second position 200*b* (FIG. 2B). Hence movement of the reference point 230.

The first housing 221 may have one or more extendable (movable) pistons, which may be disposed within respective chambers (not viewable here). The pistons 333 may extend/retract (move) radial or laterally with respect to a body axis 234.

The chambers may be in fluid communication with inner chamber 235, which may depend on the position of the main piston 224. Thus, when the piston 224 is in a first position, the pistons may be in a resting, seated, retracted, etc. position (see FIG. 2A), whereas when the piston is in a second position, the pistons may be extended outward as a result of fluid pressure (from fluid 228) acting thereon (see FIG. 2B). The presence of fluid pressure in the chambers may result from opening or unsealing of piston ports in companion with communication through housing chamber/ports.

The valve apparatus 200 may have a movable (rotatable) member 240. Although not shown here, the movable member 240 may have may have bearings or rollers associated therewith, thus ensuring the member 240 may freely move when the housing 221 is rotated.

Of significance, the moveable member 240 may be in operable communication with the main piston 240, such as by linkage 252. The form or type of linkage 252 is not meant to be limited, and may be mechanical, electrical, hydraulic, or the link, and may be direct or indirect. Whatever the case may be, the point being that the linkage 252 may provide the mechanism for which the main piston 224 may or may not be able to move.

In the operation of the valve 200 that permits flow of fluid 228, the housing 221 is rotated, and the movable member 240 moves to a position (FIG. 2B, with reference to point 230) whereby the piston 224 is able to move. In the moved or second position of FIG. 2B, fluid 228 is able to act (directly or indirectly) onto the blades 223, thereby resulting in extension thereof.

It is worth nothing that the "blades" 223 merely represent but one function of the valve 200 via its linkage 252. Other actions of the valve 200 may be possible. For example, upon proper activation of the linkage (and hence movement of the piston 224 in a sufficient manner to allow fluid 228 to the flow, other actions may occur. For example, a device may be disconnected or delivered. Other actions include open or bypass a flow port. Activate or deactivate a sliding sleeve. Activate or deactivate a latch. Redirect a flow path. Activate or deactivate cutting mechanisms. Activate or deactivate a bladder or balloons. Ability to orient and activate or deactivate, to specific orientations, all of the above.

Figure 3A:
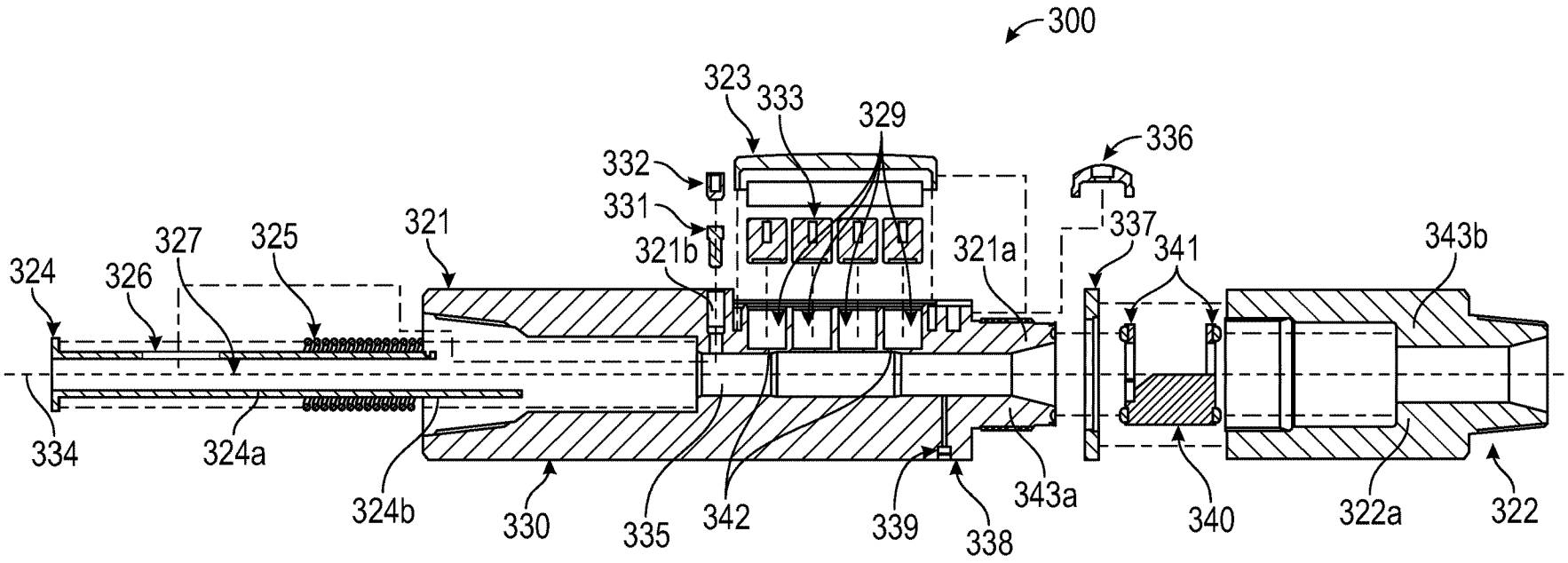
FIG. 3A shows an exploded cross-section schematic view of a valve apparatus according to embodiments of the disclosure.
Figure 3B:
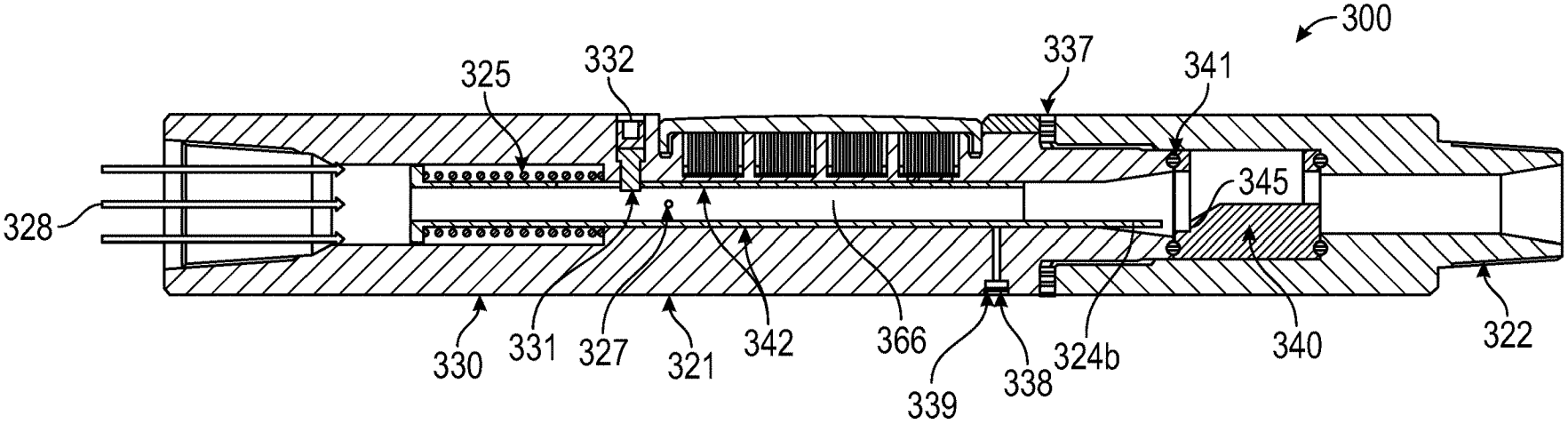
FIG. 3B shows a cross-section schematic of the valve apparatus of FIG. 3A in a retracted position according to embodiments of the disclosure.
Figure 3C:
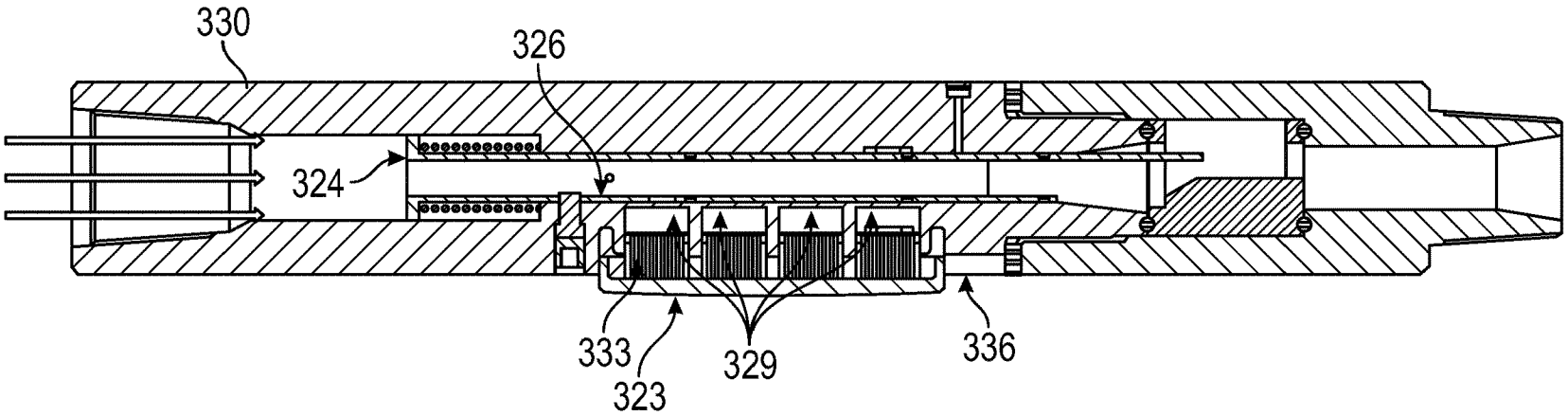
FIG. 3C shows a cross-section schematic of the valve apparatus of FIG. 3A in an extended position according to embodiments of the disclosure.

Referring now to FIGS. 3A, 3B, and 3C together, an exploded cross-section schematic view of a valve apparatus, a longitudinal cross-section schematic of the valve apparatus in a retracted position, a longitudinal cross-section schematic of the valve apparatus in an extended position according to embodiments of the disclosure, respectively, illustrative of embodiments disclosed herein, are shown.

FIGS. 3A-3C together show an embodiment of a valve apparatus (or "valve assembly", "valve", etc.) 300. The valve 300 may have a valve body configured as a first housing 321, which may be a unitary or integral structure, and thus a primary or main housing. However, as shown here, the valve 300 may also include a second housing 322. The first housing 321 may be contemplated as a blade housing, in that one or more movable blades 323 may be disposed or coupled therewith.

Although not shown here, the valve 300 may have one or more ends configured for, coupling with other devices, such as a drill string or a medical scope, allowing fluid to flow or bypass, such as a down hole valve, sliding a sleeve open or close, such as a frac sleeve, releasing a down hole object, such as a casing liner or production string.

The first housing 321 may be tubular or hollow in nature, and thus may have an inner housing passage or chamber 335. The first housing 321 may contain or house a main piston 324, which may have an elongated piston body 324*a*. The main piston 324 may have an extended piston end 324*b*. There may be an energizer (such as a spring) 325 disposed around or engaged with the piston body 324*a*. There may also be a guide pin groove 326.

The first housing 321 may have one or more (sealed) port(s) 327, which may be configured as main supply ports for (pressurized) fluid 328 to a set of piston chambers 329. The first housing 321 may also have an external scribe line 330. In embodiments, the scribe line 330 may be lined up with a respective scribe line to a bend (such as of a steerable motor assembly), or a port (such as a down hole valve), or a on off latch (such as a liner and production hanger), or a sliding sleeve (such as a frac sleeve), or a flow or no flow path (such as a circulating sub).

The first housing 321 may have or houses a guide pin 331, which may be configured to engage with the guide pin groove 326. The guide pin 331 may be held within the housing (such as a housing port 321*b*) 321 via a respective retainer 332, such as a set screw, insert pin, or the like. The first housing 321 may have one or more extendable (movable) pistons 333, which may be disposed within respective chambers 329. The pistons 333 may extend/retract (move) radial or laterally with respect to a body axis 334.

The chambers 329 may be in fluid communication with inner chamber 335, which may depend on the position of the main piston 324. Thus, when the piston 324 is in a first position, the pistons 333 may be in a resting, seated, retracted, etc. position (see FIG. 3B), whereas when the piston 324 is in a second position, the pistons 333 may be extended outward as a result of fluid pressure (from fluid 328) acting thereon (see FIG. 3C). The presence of fluid pressure in the chambers 329 may result from opening or unsealing of port 327 in companion with communication through housing chamber/ports 342.

The valve apparatus 300 may also have a cover or cap 336, a spacer 337, and pressure relief cap 338 (which may have a snap ring 339). The valve apparatus 300 may have a movable (rotatable) member 340. For example, the second or bearing housing 322 may have the movable member 340 disposed therein. The movable member 340 may have bearings or rollers 341 associated therewith. In the assembly of the apparatus 300, the bearings 341 may reside within or engage tracks or grooves 343 *a,b*. For example, the first housing 321 may have a first housing end 321*a* configured with a first set of grooves 343*a*. Analogously the second housing 322 may have a second housing end or shoulder 322*a* configured with a second set of grooves 343*b*.

Figure 6:
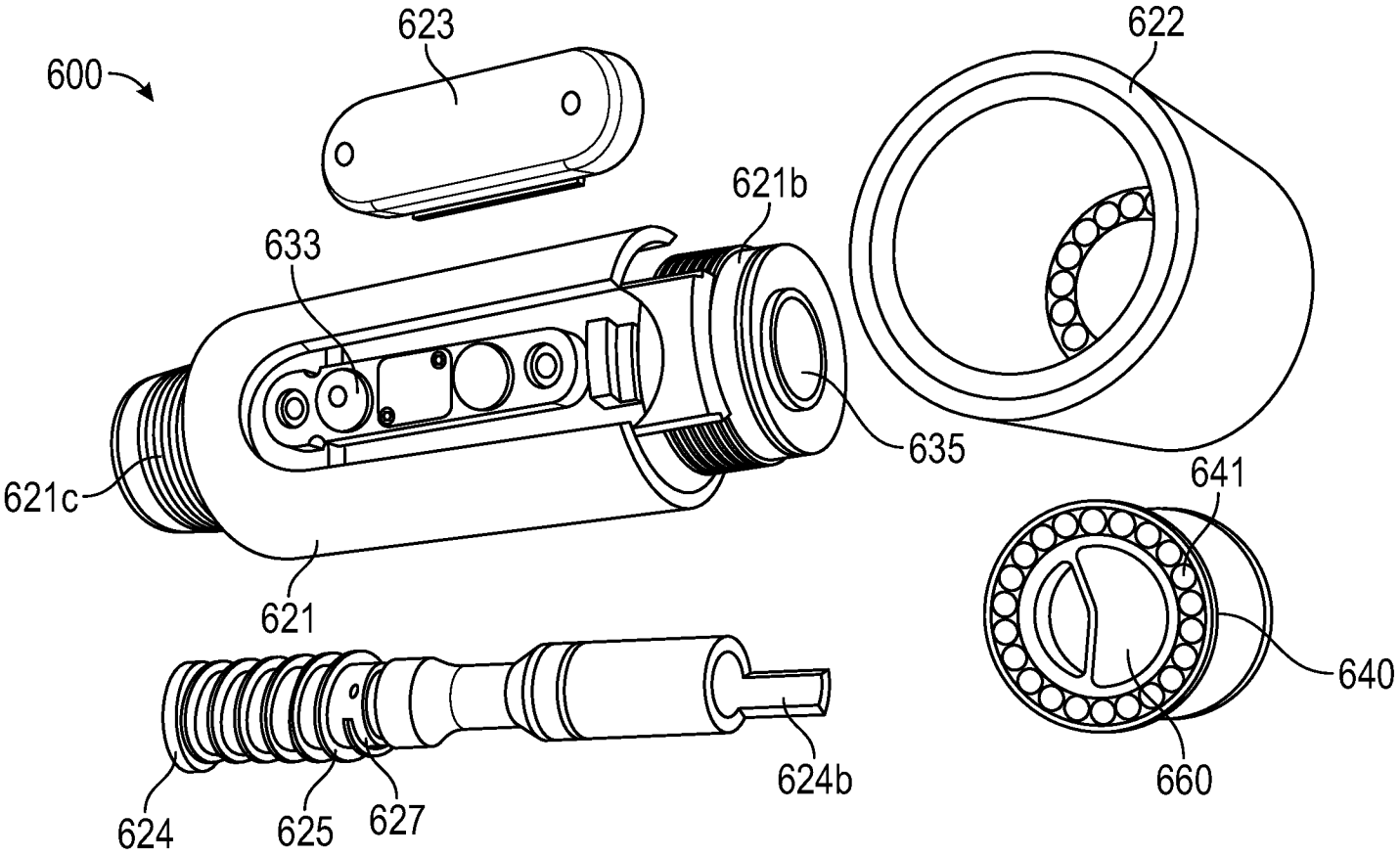
FIG. 6 shows a component view of a valve apparatus according to embodiments of the disclosure.

Referring briefly to FIG. 6, a component breakout view of a valve apparatus illustrative of embodiments disclosed herein, is shown. Although not limited to any particular type of arrangement, FIG. 6 illustrates one or more components that may be useable with valve configurations described herein. There may be a first housing 621, and while the first housing 621 may be constructed as a unitary housing for the valve 600, there may be a second housing 622. The first housing 621 and the second housing 622 may couple together, such as sealingly, threadingly, tolerance fit, and so forth. Each of the first housing 621 and the second housing 622 may be further configured with ends suitable to connect to other components, such as part of a drill string or the like. For example, the first housing 621 may have a coupler end 621*c*.

The first housing 621 may have an inner chamber or passage 635 for a main piston 624 to movingly engage and reside therein. The main piston 624 may be movable in such a manner (such as from a first position to a second position) that coincides with establishing fluid communication into a chamber of the housing. Fluid communication may be established through a piston port 627.

Generally, pressurized fluid may act on the main piston 624 in a manner that results in compression of an energizer, such as a spring 625. As this occurs, ports of the valve 600 may align, thus allowing flow. The ability of the main piston 624 to move may depend on whether an end of the piston 624*b* is sufficiently movable. That is, there may be a movable member 640 that in its respective first position prevents compression of the spring 625, but in its respective second position allows the end 624*b* to move into an opening 660, and thus compression of the spring 625 to occur. Movement of the movable member 640 may be facilitated by the presence of rollers, bearings, etc. 641.

Returning again to FIGS. 3A-3C, the operation of the valve apparatus 300 may be understood with particular reference to FIGS. 3B (retracted or first position) and 3C (extended or second position). For certain embodiments, it may be contemplated that a scribe line is lined up with the bend on a steerable motor assembly, and that each are position/oriented on the bottom or low side of an inclination in a (horizontal of) wellbore. But regardless of where the valve 300 may be used (e.g., whether in a human vein or a wellbore or a tubular or a valve or a liner hanger), the principle of the activating mechanics for the retractable stabilizer embodiment is the orientation of the scribe line, in relationship to the position of the movable member 340.

The movable member 340 may be configured as an offset weight. In this respect, because it is weighted and surrounded on top and bottom by bearings 341, the movable member 340 may settle on a low side or bottom of an inclination (within the second housing 322). As one of skill would appreciate, the force of gravity may act (i.e., pull on) the weight of the movable member 340.

The movable member 340 may be understood as the only internal mechanism that may move freely, when fluid and pressure are turned off, and the drill string orients the down hole scribe line, from the surface, to the high side or low side of the wellbore. For the purpose of this example explanation, when a pump or other fluid mover are on, and pressurized fluid 328 is delivered into the valve 300, the main piston 324 may not compress or move the energizer 325 far enough to move the extended end 324*b* of the main piston 324 down past the moveable member 340 sufficiently enough to position the main piston supply port 327 into alignment with the blade housing pressure chamber/ports 342 in order to fill the piston chambers 329 (to subsequently engage or urge the pistons 333 in order to extend the blade 323).

As such, FIG. 3B shows the retractable stabilizer is oriented in this bottom or low position, before delivering (transferring, etc.) pressurized fluid 328, the valve 300 is not oriented to allow fluid 328 to extend its blade(s) 323.

In particular, FIG. 3B shows an example where the blade 323 need not extend when the scribe reference 330 is oriented to the bottom or low side of an inclination.

One or lower portion of the movable member 340 may have no passage or opening. AS the movable member 340 may moves freely to the bottom of the housing 322 when fluid flow is off, then the passage way may be always open at the second or upper portion of the member 340.

In this bottom or low side position or orientation, there is no clear passage way for the piston end 324*b* to pass when fluid 328 is turned on and the main piston 324 tries to compress the energizer 325. As the main piston 324 may be limited or prohibited in its movement, it is not able to slide down and allow the main piston supply port 327 to line up with the blade housing pressure chamber 342 to supply pressure flow 328 to the chambers 333 in order to extend the blade(s) 232.

In some embodiments, it may be desirous to keep performing an external operation or movement (such as drilling or insertion) without extending the blade(s) 323 while keeping pressure. For example, drilling with the valve 300 and its blade 323 in the retracted position gives the ability to slide drill with minimal friction from the blade, rotary drill with a steerable mud motor to allow it to build while putting high WOB loads and pull the BHA and drill bit without an additional friction from the blades.

Only in the event of no pressurized fluid, with rotation or re-orientation to a second position, such as shown in FIG. 3C, will the valve 300 actuate, once in the new position and pressurized fluid is activated. FIG. 3C shows in particular a second or extended position. In some embodiments, this may result when a scribe line is lined up with the bend on the steerable motor assembly, and they both are position/oriented on the top or high side of the horizontal well bore inclination.

FIG. 3C in particular illustrates why the blade(s) may extend when the scribe reference 330 is oriented to the top or high side of the inclination. In this view, the moveable member has its upper portion with the passageway disposed (at least partially) therein, whereas the lower portion is solid or with catch 345 (and thus no passageway).

Since the movable member 340 may move freely inside of the housing 322 when fluid pressure is off, then the passage way may always be open at the top of the movable member. In this top or high side position or orientation, there is a clear passageway (i.e., 360, FIGS. 4A-4C) for the bottom end 324*b* to pass when fluid pressure is turned on and the main piston 324 compresses the energizer 325. The bottom end 324*b* may now slide and move sufficiently, whereby the main piston supply port 327 may align with the housing chamber/ports 342 in order to supply pressure to the piston chambers 333 to extend the blade(s) 323. Now, while the flow 328 is on, the blade(s) 323 may be extended and drilling can commence in the rotary or slide modes. As long as the drill mud and pressure stays on the blade(s) 323 may stay extended.

Once flow 328 is turned off, the blade(s) 323 may retract by a set of blade extension springs (see FIGS. 5B-5C) and force fluid from the piston chamber 333 through the blade housing pressure chamber 335 through and out of the pressure relief cap 338. The movable member 340 may settle on the bottom (side) of the housing 322, and a new position or orientation of the scribe 330 may be needed to keep the blade(s) 232 extended when fluid pressure is turned back on. This is just one of many uses of this offset weight 61 mechanism.

The principle of the activating mechanics for the retractable stabilizer embodiment shown is its scribe lines orientation in relationship to the movable member 340. The movable member 340, which may be offset and weighted, may have a center of gravity off center, and yet movable on both ends, top and bottom, by bearings 341. In this respect, the movable member 340 may always move to or settle on the low side or bottom of an inclination or respective surface.

Figures 4A, 4B, 4C:
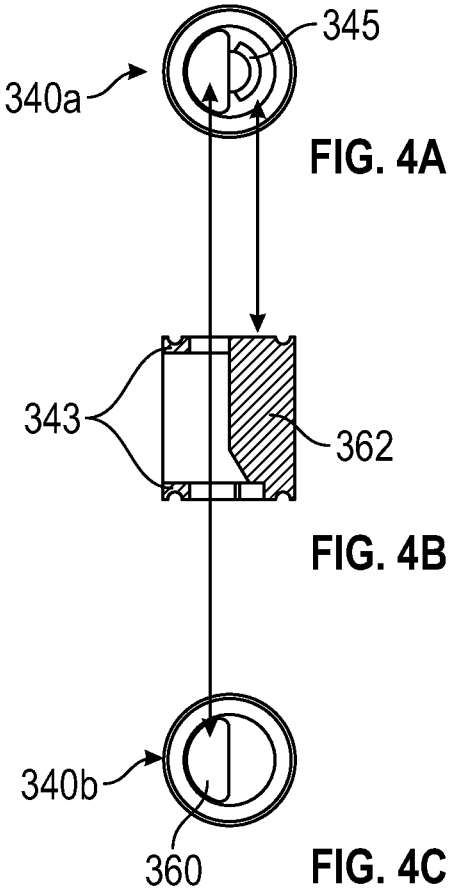
FIG. 4A shows a topside view of a movable member useable with a valve apparatus according to embodiments of the disclosure.
FIG. 4B shows a longitudinal side cross-sectional view of the movable member of FIG. 4A according to embodiments of the disclosure.
FIG. 4C shows a bottom view of the movable member of FIG. 4A according to embodiments of the disclosure.

Referring briefly to FIGS. 4A, 4B, and 4C together, a topside view of a movable member useable with a valve apparatus, a longitudinal side cross-sectional view of the movable member, and a bottom view of the movable member, respectively, illustrative of embodiments disclosed herein, are shown.

FIGS. 4A-4C together show the movable member 340 may have a member (offset) body 362 with a first and second ends or arms 340 *a,b*. The arms 340 *a,b* may be configured with respective rails or tracks 343, which may be engaged with rollers or bearings (see FIG. 3C). One side or portion of the movable member 340 may be configured with a shoulder (or stop, catch, etc.) that limits or prohibits movement of a proximate component (such as main piston end 324*b*, FIG. 3B). Another side or portion of the movable member 340 may be configured with an opening or hollow 360 of suitable shape to allow the proximate component to move (end 324*b*, FIG. 3C).

Returning to FIGS. 3A-3C, when a pump or other type of fluid mover are on, the pressurized fluid 328 travels or flows into valve 300. In the position of FIG. 3C, the fluid 328 may now compress the piston 324 and energizer 325 in sufficient enough manner, and the end 324*b* is now free to move past or beyond a shoulder stop 345 of the movable member 340.

The piston 324 may now move far enough past the movable member 340 whereby the main piston supply port 327 aligns sufficiently with the position of the blade housing pressure chamber/port 342 in order to fill the piston chambers 329. As pressurized fluid 328 may now enter the chambers 329, the pistons 333 may be urged outwardly, thus extending the blade(s) 323 coupled therewith.

Since the valve 300 is oriented in this top or second position, before delivering the fluid pressure 328 to the chambers 329, it will extend the blade(s) 323 or blades until pressure is reduced or completely stopped, then the blade(s) may retract. As such, the blade(s) 323 may be biased to the retracted or first position of FIG. 3B.

If the intent is to move ahead with the blade(s) 323 extended, then keeping the pressurized fluid 328 flowing will produce these results. For example, drilling with the blade 323 in the extended position gives the ability to slide drill with lift and more friction from the blade to produce slightly lower inclination and direction results, rotary drill with a steerable mud motor to allow it to hold while putting high WOB loads, clean the well bore better while rotary drilling, drop angle while rotary drilling and smooth out the areas in the well bore where slide drill modes were used, back ream the well bore when POOH after reaching total depth (TD), lift the drill bit off center while using a rotary steerable BHA with no mud motor, etc.

If the intent is to move ahead with the blade(s) 323 not extended, then keeping the pressurized fluid 328 flowing will produce these results. For example, drilling with the blade 323 in the non-extended position gives the ability to slide drill with less friction from the blade to produce slightly higher inclination and direction results, rotary drill with a steerable mud motor to allow it to build while putting high WOB loads, build angle while rotary drilling, POOH after reaching total depth (TD) with less friction, drop the drill bit off center while using a rotary steerable BHA with no mud motor, etc.

Figure 5A:
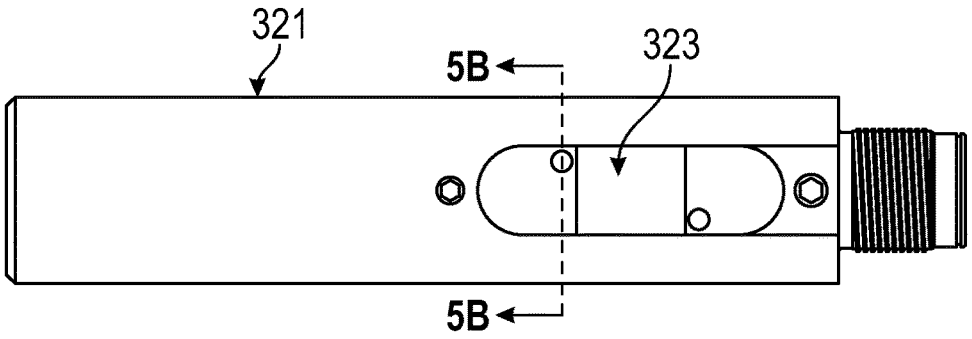
FIG. 5A shows a longitudinal side view of a valve apparatus according to embodiments of the disclosure.
Figure 5B:
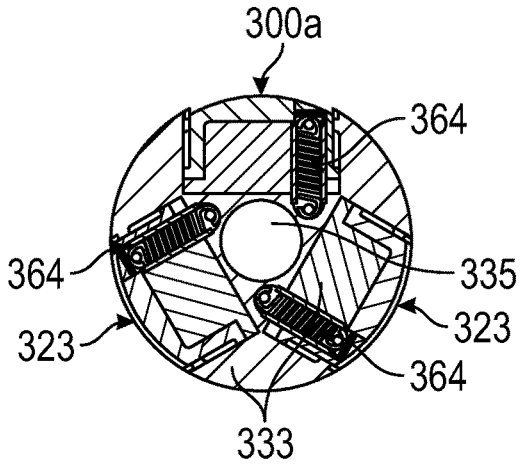
FIG. 5B shows a lateral cross-sectional view of the valve apparatus of FIG. 5A in a retracted position according to embodiments of the disclosure.
Figure 5C:
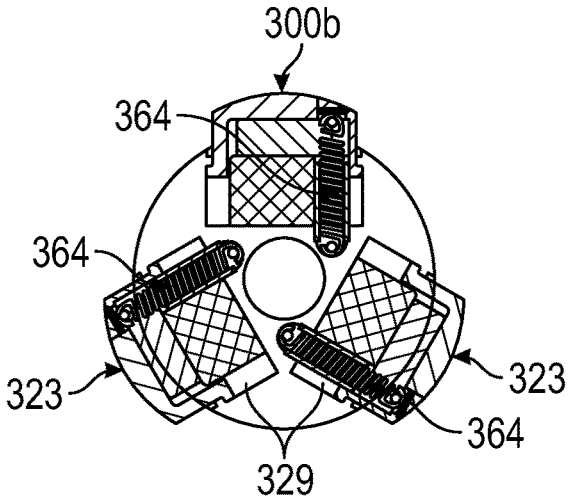
FIG. 5C shows a lateral cross-sectional view of the valve apparatus of FIG. 5A in an extended position according to embodiments of the disclosure.

Referring now to FIGS. 5A, 5B, and 5C together, a longitudinal side view of a valve apparatus, a lateral cross-sectional view of the valve apparatus in a retracted position, and a lateral cross-sectional view of the valve apparatus of FIG. 5A in an extended position, respectively, illustrative of embodiments disclosed herein, are shown.

FIGS. 5A-5C together show a first housing 321 configured with one or more blades 323, which may be coupled with respective springs 364. For example, FIG. 5B shows a retracted (contracted, etc.) position, whereas FIG. 5C shows an extended position. When pressurized fluid is turned off, the springs 364 may be biased in a manner such that springs 364 may pull back (or otherwise hold retracted) the blades 323 within the housing 321.

When the valve 300 is rotated or otherwise moved in a sufficient manner to facilitate pressurization, and fluid pressure is turned on, the springs 364 may extend, and analogously, the blades 323 may extend.

It is important to note that the embodiment of this current disclosure should not be limited to only 2 designated pointed or oriented settings in one direction to activate the main piston supply port to line up with the blade housing pressure chamber to supply or shut off drill mud and pressure to the piston chambers to extend or retract the blade or blades. Embodiments herein may include multiple pointed or oriented positions that can each independently extend or retract a multiple or singular designated blade, blades, pad, pads, cutters, latch, latches, external flow and or no flow, etc. at any designed area on the blade housing.

For example, in the current embodiment it references oriented to the bottom or low side of an inclination to retract a blade(s) and oriented to the top or high side to extend the blade(s). These pointed or oriented positions could be reversed for opposite functionality, or could be oriented or pointed to the left or right of an azimuth direction for additional functionality. There can also be more than two possible pointed or oriented positions that could perform multiple functions to the retractable stabilizer housing. These options can be designed into the scope of the current disclosure and its internal and external component functionality.

In addition, it was mentioned earlier, that it was not intended to suggest the current disclosure concept to only be limited to the subsurface drilling industry. This disclosure has applications in medical, industrial, automotive and many other industries that can use similar functionality to provide results mentioned in the embodiment of this disclosure.

While preferred embodiments of the disclosure have been shown and described, modifications thereof may be made by one skilled in the art without departing from the spirit and teachings of the disclosure. The embodiments described herein are exemplary only and are not intended to be limiting. Many variations and modifications of the embodiments disclosed herein are possible and are within the scope of the disclosure. For example, the current embodiment describes only two specific orientations, upper or lower, to achieve it functions, but there can be multiple orientations, (upper, lower, left, right, midway, etc.) that can activate multiple functions as described within the current embodiment.

Where numerical ranges or limitations are expressly stated, such express ranges or limitations should be understood to include iterative ranges or limitations of like magnitude falling within the expressly stated ranges or limitations. The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the preferred embodiments of the present disclosure. The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

What is claimed is:

1. A valve apparatus comprising:

a valve body comprising a first valve end configured for coupling, a second valve end also configured for coupling, and a flow passage;

a main piston movably disposed within the flow passage, the main piston configured to move to and from a first piston position to a second piston position, and the main piston having a main piston body, an extended piston end, and an inner piston passageway;

a chamber formed in the valve body, and comprising an at least one actuatable device;

a movable member movably disposed within the valve body, and between the first valve end and the second valve end, the movable member comprising: a no-go position for stopping movement of the main piston, and a go position to facilitate movement of the extended piston end;

wherein rotation of the valve apparatus results in rotation of the movable member in a sufficient manner to allow the main piston to move from the first position to the second position, wherein an energizer is disposed around the main piston body, and wherein the second position corresponds with fluid pressure entering the chamber to the actuatable device.

2. The valve apparatus of claim 1, wherein the actuatable device is configured to move a blade outward from the valve body to an extended position when the main piston is in the second position, wherein the valve body comprises a first housing coupled with a second housing, wherein the chamber is disposed within the first housing, and the movable member is disposed within the second housing.

3. The valve apparatus of claim 2, wherein the energizer comprises a coiled spring, and wherein the first housing is coupled directly with the second housing.

4. The valve apparatus of claim 1, wherein the main piston comprises a piston port, wherein the valve body comprises a body port proximate the chamber, wherein when the main piston is in its first position the piston port and the body port are unaligned in order to prevent flow to the chamber, wherein a spring is disposed in the chamber, and is configured to bias the blade to a retracted position, and wherein when the main piston is in its second position the piston port and the body port are aligned in order to establish fluid flow between the chamber and inner piston passageway.

5. The valve apparatus of claim 1, wherein the movable member comprises a solid member body weighted portion and an open portion, wherein the solid member body weighted portion is configured to prevent the main piston from moving to the second position, and wherein the solid member body weighted portion is configured with a catch.

6. The valve apparatus of claim 5, wherein upon rotation of the valve apparatus and application of fluid pressure, the extended piston end is able to move whereby the main piston moves to the second position.

7. The valve apparatus of claim 5, wherein the movable member comprises a set of tracks, wherein a set of rollers is disposed in the set of tracks.

8. The valve apparatus of claim 1, wherein at least a portion of fluid pressure in the chamber is relieved out of a pressure relief cap disposed in the valve body.

9. A valve apparatus comprising:

a valve body comprising a first valve end configured for coupling, a second valve end also configured for coupling, and a flow passage;

a main piston movably disposed within the flow passage, the main piston configured to move to and from a first piston position to a second piston position, and the main piston having a main piston body, an extended piston end, and an inner piston passageway;

a chamber formed in the valve body, and comprising an at least one actuatable device disposed therein;

an extendable blade engaged with the at least one actuatable device;

a movable member movably disposed within the valve body, and between the first valve end and the second valve end, the movable member comprising: a no-go position for stopping movement of the main piston, and a go position to facilitate movement of the extended piston end;

wherein an energizer is disposed around the main piston body, wherein upon rotation of the valve apparatus and application of a fluid pressure, the extended piston end is able to move whereby the main piston moves to the second position, and wherein the second position corresponds with the fluid pressure entering the chamber to the actuatable device, and the extendable blade moved to an extended position that is outward from the valve body.

10. The valve apparatus of claim 9, wherein the valve body comprises a first housing coupled with a second housing, and wherein the chamber is disposed within the first housing, and the movable member is disposed within the second housing.

11. The valve apparatus of claim 10, wherein the main piston comprises a piston port, wherein the valve body comprises a body port proximate the chamber, wherein when the main piston is in its first position the piston port and the body port are unaligned in order to prevent flow to the chamber, and wherein when the main piston is in its second position the piston port and the body port are aligned in order to establish fluid flow between the chamber and inner piston passageway.

12. The valve apparatus of claim 11, wherein the movable member comprises a member body weighted portion and an open portion, wherein the member body weighted portion is configured to prevent the main piston to move to the second position, and herein the solid member body weighted portion is configured with a catch.

13. The valve apparatus of claim 12, wherein the movable member comprises a set of tracks, and wherein a set of rollers is disposed in the set of tracks.

14. The valve apparatus of claim 13, wherein at least a portion of fluid pressure in the chamber is relieved out of a pressure relief cap disposed in the valve body.

15. A valve apparatus comprising:

a valve body comprising a first valve end configured for coupling, a second valve end also configured for coupling, and a flow passage;

a main piston movably disposed within the flow passage, the main piston configured to move to and from a first piston position to a second piston position, and the main piston having a main piston body, an extended piston end, and an inner piston passageway;

a chamber formed in the valve body, and comprising an at least one actuatable device disposed therein;

an extendable blade engaged with the at least one actuatable device;

a movable member movably disposed within the valve body, and between the first valve end and the second valve end, the movable member comprising: a no-go position for stopping movement of the main piston, and a go position to facilitate movement of the extended piston end;

wherein upon rotation of the valve apparatus and application of a fluid pressure, the extended piston end is able to move whereby the main piston moves to the second position, wherein the second position corresponds with the fluid pressure entering the chamber to the actuatable device, and the extendable blade moved to an extended position that is outward from the valve body, wherein the main piston comprises a piston port, and wherein the valve body comprises a body port proximate the chamber.

16. The valve apparatus of claim 15, wherein the valve body comprises a first housing coupled with a second housing, wherein the chamber is disposed within the first housing, and the movable member is disposed within the second housing, and wherein an energizer is disposed around the main piston body.

17. The valve apparatus of claim 16, wherein when the main piston is in its first position the piston port and the body port are unaligned in order to prevent flow to the chamber, and wherein when the main piston is in its second position the piston port and the body port are aligned in order to establish fluid flow between the chamber and inner piston passageway.

18. The valve apparatus of claim 17, wherein the movable member comprises a solid member body weighted portion and an open portion, wherein the solid member body weighted portion is configured to prevent the main piston from moving to the second position.

19. The valve apparatus of claim 18, wherein the movable member comprises a set of tracks, and wherein a set of rollers is disposed in the set of tracks.

20. The valve apparatus of claim 19, wherein at least a portion of fluid pressure in the chamber is relieved out of a pressure relief cap disposed in the valve body.

* * * * *